US005579866A

United States Patent [19]

Rowell

[11] Patent Number: 5,579,866

[45] Date of Patent: Dec. 3, 1996

[54] SUSPENDED ACCESS PLATFORM

[75] Inventor: Steven B. Rowell, Atlanta, Ga.

[73] Assignee: Sky Climber, Inc., Stone Mountain, Ga.

[21] Appl. No.: 272,123

[22] Filed: Jul. 8, 1994

[51] Int. Cl.[6] ..... E04G 3/00

[52] U.S. Cl. ..... 182/150; 182/152

[58] Field of Search ..... 182/150, 142, 182/143, 144, 152, 113

[56] References Cited

U.S. PATENT DOCUMENTS

| | | | |
|---|---|---|---|
| 313,511 | 3/1885 | Monjeau . | |
| 1,520,414 | 12/1924 | Hamilton . | |
| 1,943,871 | 1/1934 | Landberg | 182/152 |
| 2,558,419 | 6/1951 | Cramer | 304/40 |
| 2,916,102 | 12/1959 | Reinhardt | 182/152 |
| 2,918,985 | 12/1959 | Rizzuto | 182/223 |
| 2,965,194 | 12/1960 | Lotz | 182/102 |
| 3,072,217 | 1/1963 | Hiyama | 182/63 |
| 3,213,964 | 10/1965 | Tucker et al. | 182/119 |
| 3,420,332 | 1/1969 | Textor | 182/128 |
| 3,752,262 | 8/1973 | Helms | 182/113 |
| 3,851,729 | 12/1974 | Gordon | 182/150 |
| 3,907,066 | 9/1975 | Newton | 182/112 |
| 4,000,789 | 1/1977 | Zahner | 182/152 |
| 4,413,707 | 11/1983 | Lienhard, Sr. | 182/150 |
| 4,493,578 | 1/1985 | D'Alessio | 403/49 |
| 4,496,026 | 1/1985 | Meehan | 182/128 |
| 4,620,612 | 11/1986 | Enoki et al. | 182/113 |
| 4,733,896 | 3/1988 | Klein | 294/67.1 |
| 4,761,847 | 8/1988 | Savage et al. | 14/69.5 |
| 4,766,975 | 8/1988 | Whitson | 182/150 |
| 5,007,501 | 4/1991 | Baston | 182/128 |
| 5,121,812 | 6/1992 | Ochiai et al. | 182/152 |
| 5,145,032 | 9/1992 | Puccinelli et al. | 182/142 |

*Primary Examiner*—Alvin C. Chin-Shue
*Attorney, Agent, or Firm*—Deveau, Colton & Marquis

[57] ABSTRACT

A suspended access platform which can be easily disassembled and folded to facilitate storage or relocation of the platform. The components of the suspended access platform are connected together by recessed pockets on some components for accepting legs on other components and by lock-pin arrangements which include tethered pins which are permanently tethered to particular components of the platform. The suspended access platform has a folding floor which comprises two floor half panels which are hinged together to allow the floor to be folded. The floor is connected to side panels which in turn are connected to front and back stirrups or connecting frames. The stirrups are each comprised of two half stirrups which are rotatably connected by a hinging mechanism. When the half stirrups are locked in place, a suspension mechanism is removably fastened to the half stirrups. When the half stirrups are not locked in place the hinging mechanism allows the half stirrups to rotate with respect to one another once the suspension mechanism has been removed. The connecting frames are each comprised of two half frames which are rotatably connected by a hinging mechanism. The suspended access platform can be quickly assembled and disassembled and the floor, end stirrups and connecting frames can be folded to facilitate storage or transport of the components. The length of the platform may be easily modified by utilizing a folding connecting frame which incorporates a hinging mechanism.

15 Claims, 6 Drawing Sheets

SUSPENDED ACCESS PLATFORM

BACKGROUND OF THE INVENTION

The invention relates to a suspended access platform and, more particularly, to a suspended access platform comprised of a folding floor, folding end stirrups and side panels. All of the components of the suspended access platform are assembled with lock pins. By using lock pins to assemble the platform, it can be easily assembled and disassembled and the floor, end stirrups, and connecting frames can be folded to allow the platform to be easily stored or transported to a different location.

It is often times necessary to use scaffolds, or suspended access platforms, in areas which have little room for maneuvering the platforms, such as through boiler access ports. The platforms must be disassembled to allow the components to be carried through the narrowly confined areas. The platform must then be reassembled once it has been moved to the location at which it is to be used (e.g., inside of a boiler). If the platforms are complicated in design, considerable amounts of time will usually be required to reassemble the platforms. Although it is known in the industry to design platforms to be modular in construction, at present the platforms are generally not foldable in a way to allow them to pass through, for example, an 18" access port to a boiler. Platforms have been created which are able to be disassembled to be moved through narrow openings and which have certain components which are able to be collapsed or folded to facilitate movement or storage of the platform.

Baston, U.S. Pat. No. 5,007,501, discloses a platform which is fabricated from small construction elements, each of which is small enough in size to be inserted through a small access opening in a pressure vessel. The elements are then assembled within the vessel by pinning them together with high-strength pins. The platform is constructed vertically and then rotated to its horizontal working orientation. The platform is disassembled by rotating it back to its vertical orientation and progressively removing all of the elements so that the elements can then be individually moved through the access opening. The platform is comprised of a large number of tresses, each tress comprised of a plurality of members which are bolted together. After the trusses have been connected, deck panels are locked to the trusses of the platform with pins.

Klein, U.S. Pat. No. 4,733,896, discloses a lift container for use in erecting scaffolding within areas which have small access openings. The lift container is modular in design so that it can be disassembled in order to move the constituent parts through the small access openings. The container is comprised of concrete forming panels. The side and bottom panels are fixedly joined by corner brackets in the form of slotted angle irons designed to accommodate wedge bolt fasteners through the slots in the backing frame of the concrete forming panels. The side panels are typically 18" by 8' and there is at least one end panel which is typically 3' by 18". The end panel and side panels are attached by corner brackets which are slotted to accommodate wedge bolts. A plurality of side panels may be joined end-to-end by pairs of wedge bolts.

Newton, U.S. Pat. No. 3,907,066, discloses a wing-type scaffold system which is comprised of a main-cage section having wing sections hingedly connected on opposite sides thereof. The wing sections can be pivoted vertically upward to permit the entire scaffold to be raised or lowered about obstacles which would obstruct vertical movement of the scaffold with the wing sections extended.

Rizzuto, U.S. Pat. No. 2,918,985, discloses a foldable platform extension wherein a plate is attached to a frame by hinges. The plate can be locked in an operative position or folded in an inoperative position. The foldable platform extension is particularly useful as an extension for a step of a ladder or step ladder because in the folded position, the extension will not impair the usefulness of the step immediately below the folded extension.

Savage et al., U.S. Pat. No. 4,761,847, discloses a folding ramp which is comprised of a plurality of rectangular panels which are pivotably hinged along adjacent side walls so that the ramp can be folded into a compact state or unfolded into a second state for supporting a load.

As is evident from the above discussion, various attempts have been made to create structures which can be easily assembled and disassembled to facilitate use of the structure or movement of the structure in confined areas. However, a need still exists in the art for a suspended access platform which can be quickly and easily assembled and disassembled and which is comprised of components which can fit through an 18" opening or which can be folded to fit through an 18" opening. None of the prior art suspended access platforms achieve these goals. The present invention provides a novel design for achieving these and other goals.

SUMMARY OF THE INVENTION

In accordance with the present invention, a suspended access platform is provided which can be easily and quickly assembled and which can be easily and quickly disassembled and collapsed to facilitate storage or relocation of the platform. The components of the suspended access platform of the present invention are connected together by locking pin arrangements comprised of tethered pins which are permanently connected to the platform. The suspended access platform has a folding floor comprised of two floor half panels which are hinged together to allow the floor to be folded when the suspended access platform is disassembled. The floor is connected to side panels by floor pins which can be easily inserted and easily removed. The side panels are connected to front and back end stirrups or to connecting frames by the side panel legs which fit into recesses in the stirrups and by locking pin arrangements. The stirrups are each comprised of two half stirrups which are rotatably connected together by a hinging mechanism. A suspension mechanism is removably connected to each of the end stirrups by locking pin arrangements to allow the platform to be suspended once it has been assembled. When the hinging mechanisms are locked, the end stirrups are in the operative position. A hoist mechanism can then be installed using mounting holes on the suspension mechanism to allow the platform to be suspended above the floor or lower surface. When the half stirrups are not locked in place, the hinging mechanism allows the half stirrups to rotate with respect to one another so that they can be folded once the suspended access platform has been disassembled.

Accordingly, it is an object of the present invention to provide a suspended access platform which can be easily assembled and disassembled.

It is another object of the present invention to provide a suspended access platform which can be disassembled so that the elements of the platform can fit through an 18" opening, such as a boiler access port.

It is another object of the present invention to provide a folding floor for a suspended access platform which can be folded once the suspended access platform has been disassembled to facilitate storage or transport of the folding floor.

It is yet another object of the present invention to provide end stirrups or connecting frames for a suspended access platform which can be folded to facilitate storage or transport of the end stirrups or connecting frames.

It is another object of the present invention to provide a suspended access platform which can be manually assembled without tools by utilizing locking-pin arrangements.

It is yet another object of the present invention to provide a suspended access platform which meets OSHA requirements.

It is yet another object of the present invention to provide a suspended access platform which is lightweight in construction.

It is yet another object of the present invention to provide a suspended access platform which can be quickly assembled by one person.

It is yet another object of the present invention to provide a suspended access platform which can be easily extended to variable lengths.

These and other objects of the present invention will become apparent from the following detailed description of the invention and the claims.

DETAILED DESCRIPTION OF THE PRESENT INVENTION

Figure 1:
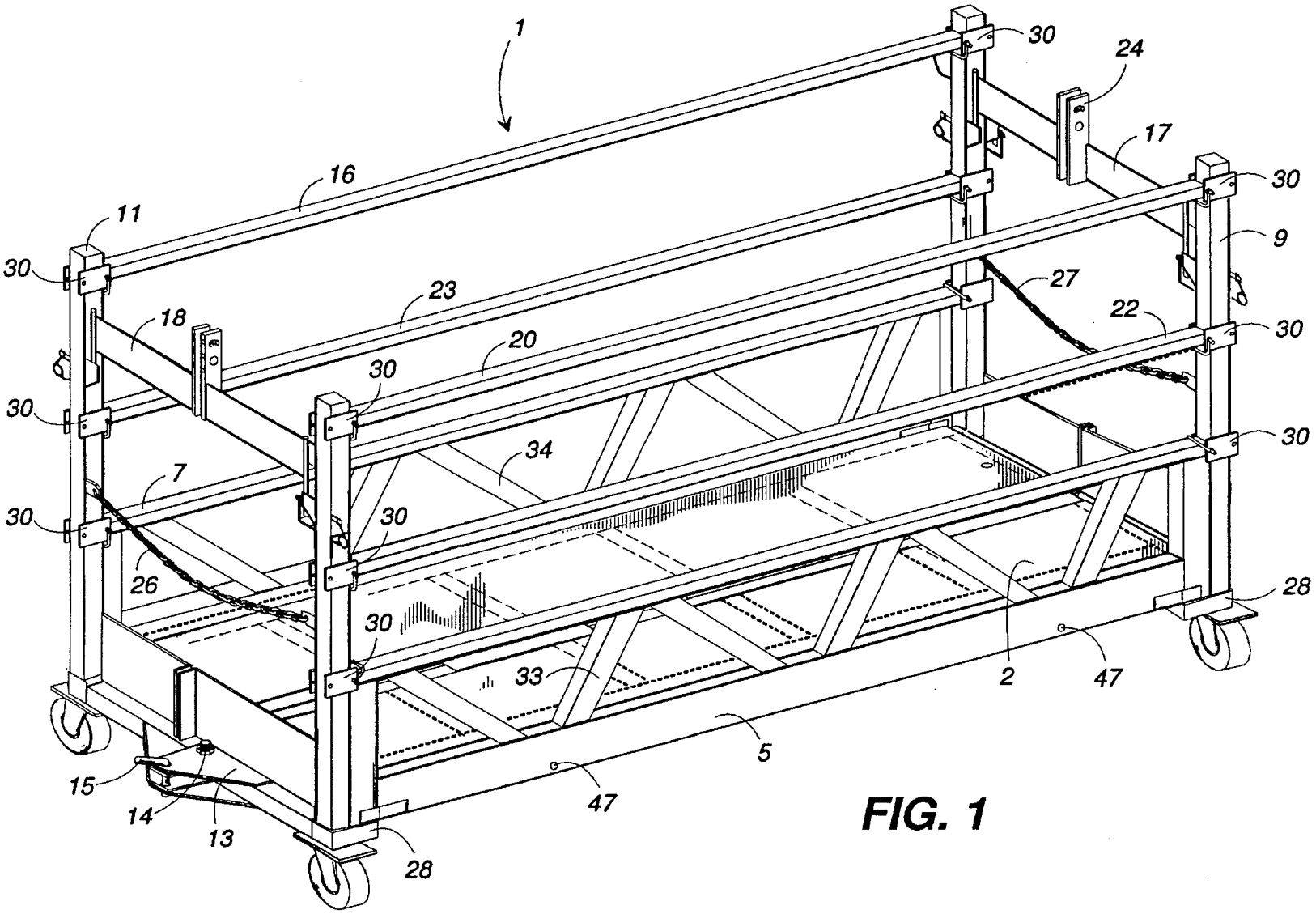
FIG. 1 illustrates a perspective view of the suspended access platform of the present invention.

FIG. 1 illustrates a preferred embodiment of the suspended access platform 1 of the present invention. The suspended access platform is comprised of a folding floor 2 which is removably connected to the side panels 5 and 7 by floor pins which are inserted through holes 47 in the side panel 5 and which pass through the folding floor and through the side panel 7 to lock the floor in the flat position. The side panels 5 and 7 are connected to the end stirrups 9 and 11 by locking pin arrangements 30. The side panels are also seated in recesses 28 formed on the end stirrups as shown. Side rails 16, 20, 22 and 23 are removably connected to the end stirrups by locking pin arrangements 30. The end stirrups are adapted to have optional casters 4 connected to the bottom ends thereof to allow the access platform to be rolled along the floor.

Figure 2:
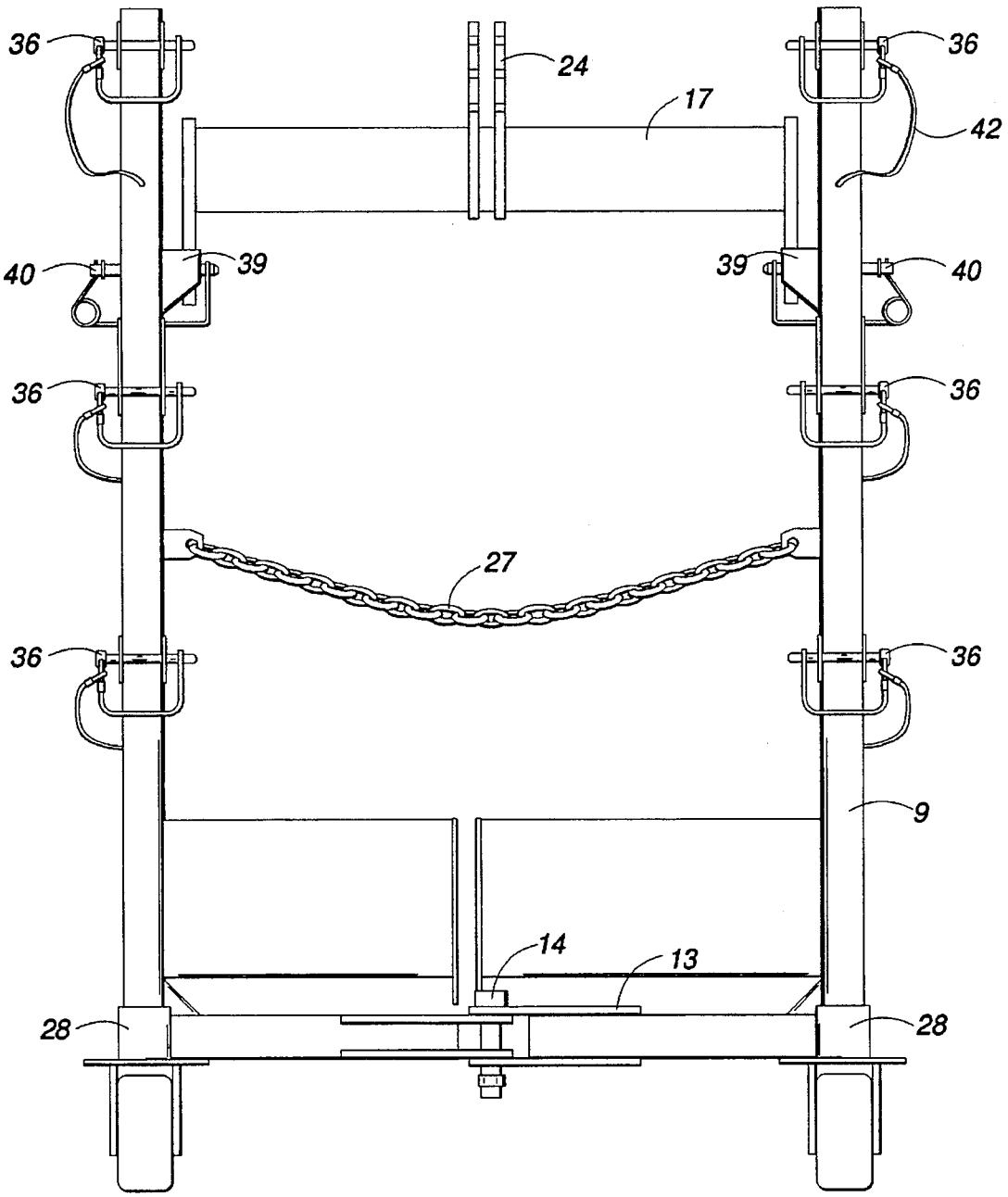
FIG. 2 illustrates a plan view of one of the end stirrups in its operative position.
Figure 6A:
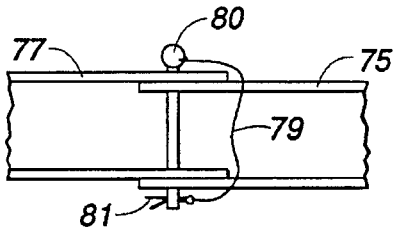
FIGS. 6*a* and 6*b* illustrate the hinging mechanism for the end stirrups and connecting frame.
Figure 6B:
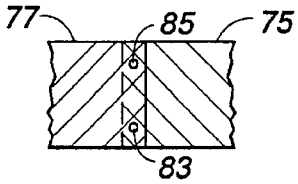

FIG. 2 illustrates a plan view of one of the end stirrups 9 from the side which constitutes the inner side of the platform. The end stirrup 9 is comprised of two half stirrups which are rotatably connected together by a hinging mechanism 13. The hinging mechanism is comprised of outer and inner hinge weldments. The hinging mechanism can be locked in its operative position as shown in FIG. 2 to prevent the half end stirrups from rotating with respect to each other by inserting a pin 15 (seen in FIG. 1) through concentrically aligned holes in the outer and inner weldments, as discussed below with respect to FIGS. 6*a* and 6*b*. A suspension mechanism 17 is removably connected to the top of each end stirrup. When the end stirrup is in the operative position, the suspension mechanism is connected across the top of the end stirrup by locking pin arrangements 39 and pin 40. A hoist mechanism (not shown) can then be installed using mounting holes 24 on the suspension mechanism to allow the access platform to be suspended. When the locking pin is removed from the hinging mechanism and the platform has been disassembled, the end stirrup 9 can be folded such that the half stirrups are flush against each other.

The locking pin arrangements 30 are provided for removably connecting the side panels 57 to the end stirrup. The locking pin arrangements 30 are also provided for removeably connecting the side rails 16, 20, 22 and 23 to the end stirrups. The locking pins are tethered to the end stirrups by lanyards 42 to prevent the locking pins from being lost or removed. A chain 27 across the end stirrup provides a removable midrail.

Figure 3A:
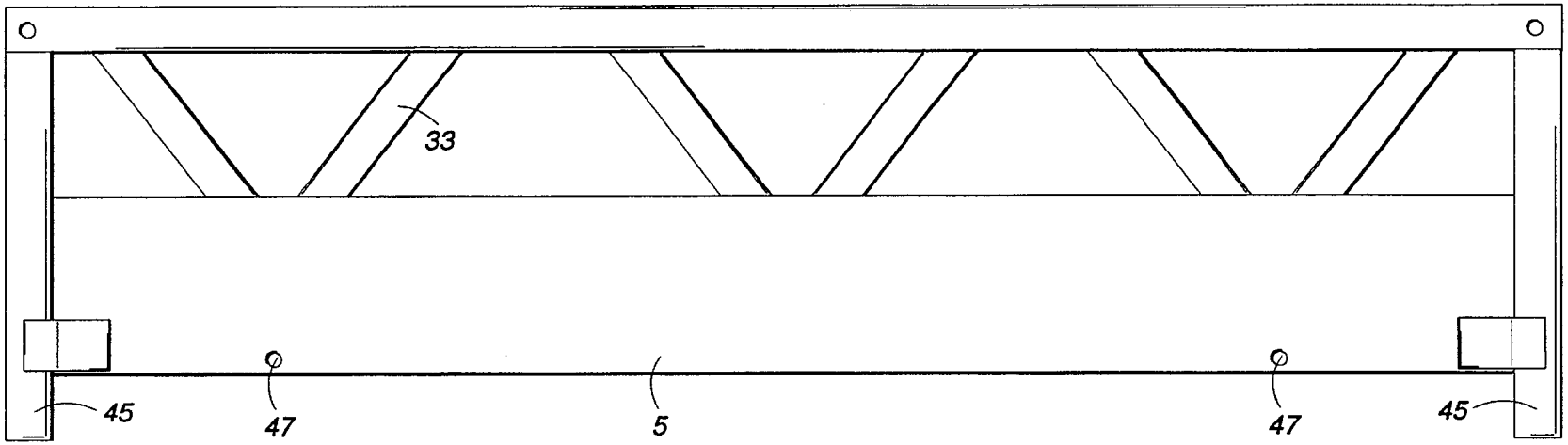
FIG. 3*a* illustrates a plan view of one of the side panels of the suspended access platform of the present invention.
Figure 3B:
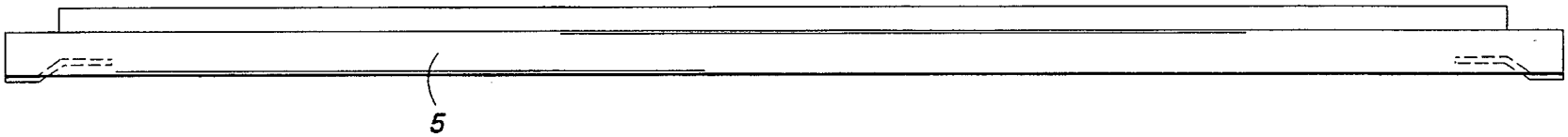
FIG. 3*b* illustrates a top view of the side panel shown in FIG. 3*a*.

FIG. 3*a* illustrates a front elevational view of one of the side panels 5 of the suspended access platform of the present invention. The side panels are preferably comprised of aluminum. Each side panel preferably has two holes 47 formed in the base thereof to accommodate the floor pins. Each side panel has a front leg 45 and a back leg 45 which are seated into the recesses 28 formed in the end stirrups. A hole is formed in the top corners of each side panel. The end stirrups have locking pin arrangements connected thereto which allow a locking pin to be inserted through the locking pin arrangement and through the hole formed in the top corners of the side panel to allow the side panel to be removably connected to the end stirrup, as shown in FIG. 1. FIG. 3*b* illustrates a top view of the side panel 5 which illustrates the lip 6 on the inner side of the side panels for supporting the floor. The side panels are substantially flat so that once the suspended access platform has been collapsed the side panels can be stacked to facilitate storage or transport of the side panels. The side panel comprises a truss 33 which adds structural support to the side panel. The side bars 48 and top bar 43 are preferably aluminum extrusions. The components of the side panel 5 are welded together and straps 46 which are preferably aluminum reinforcement plates are welded to the side bars and the side rail 53 to provide additional structural support.

Figure 4A:
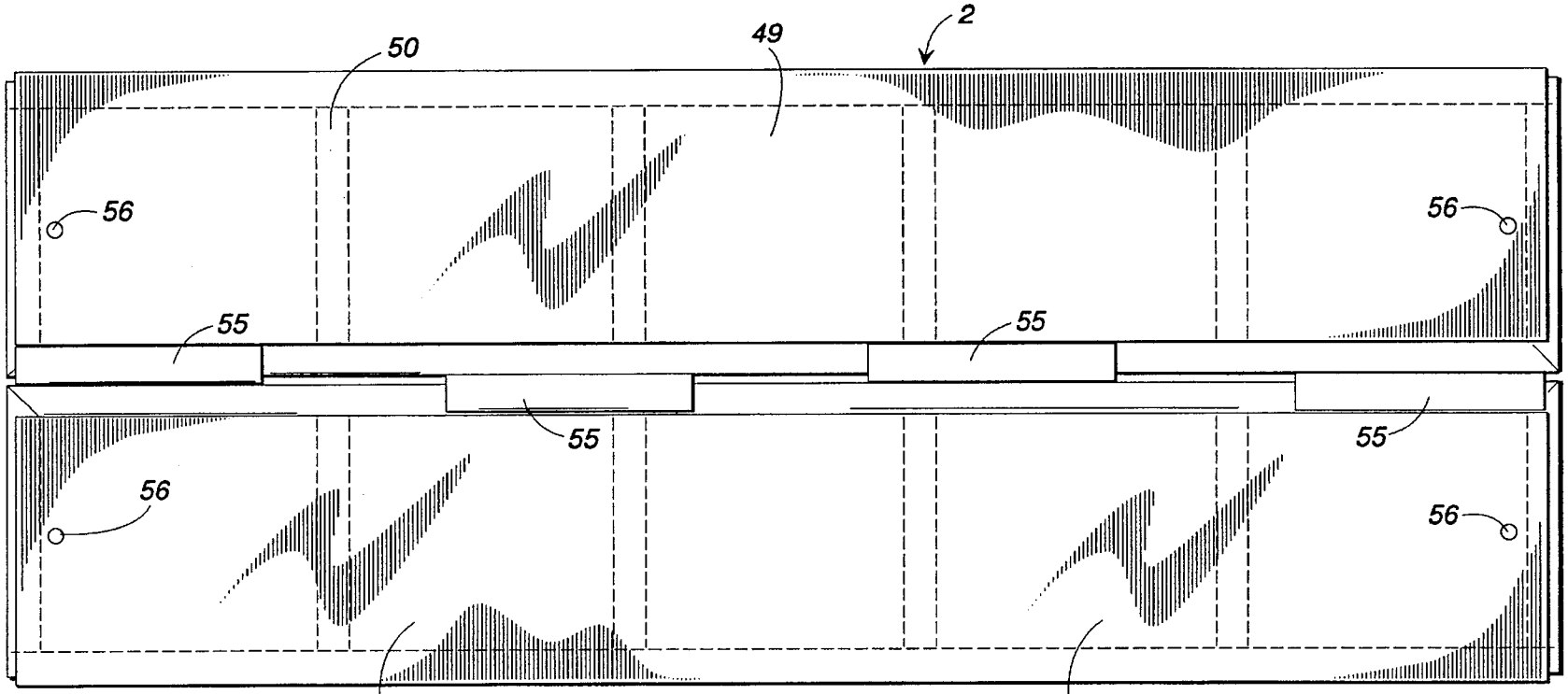
FIG. 4*a* illustrates a top view of the floor in a flat position.
Figure 4B:
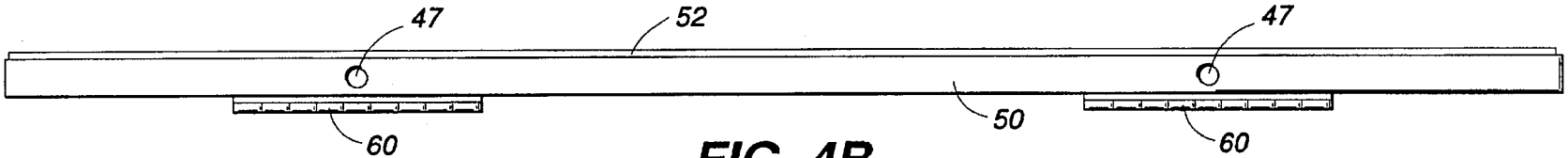
FIG. 4*b* illustrates a side view of the floor in the flat position.
Figure 4C:
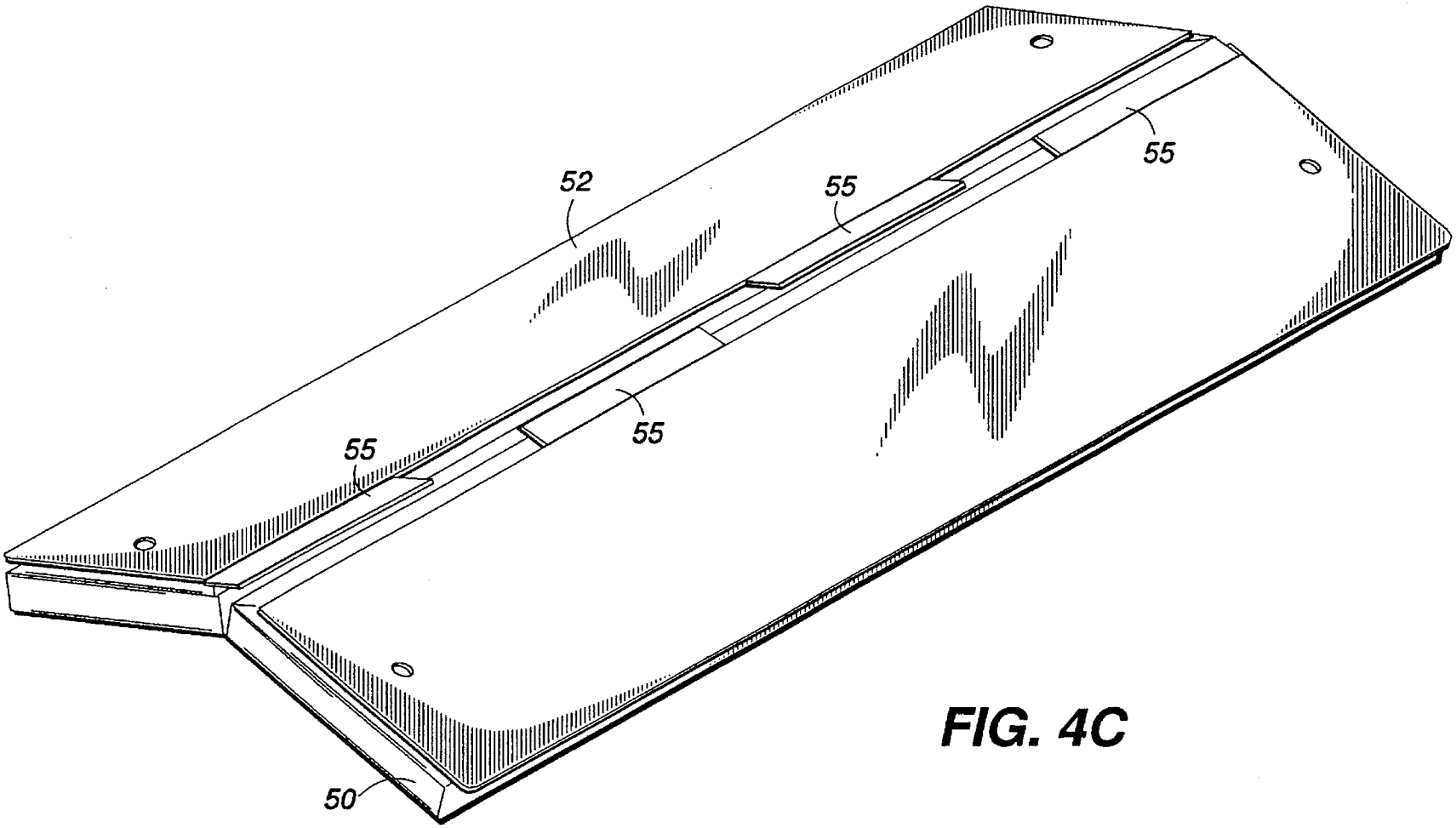
FIG. 4*c* illustrates a perspective view of the floor in a slightly folded position.

FIG. 4*a* illustrates a preferred embodiment of the folding floor of the suspended access platform of the present invention wherein the folding floor 2 is in a flat, operative position. The folding floor is preferably comprised of two floor half panels 49 and 51 which are connected to each other along one side of each panel by a plurality of hinges. Each floor half panel has a plurality of flanges 55 formed thereon. The flanges are alternatingly opposed such that, when the floor is in the flat operative position, the flanges connected to each floor half panel overlap the other floor half panel to provide the floor with primary structural support. FIG. 4*b* illustrates a side view of the floor of FIG. 4*a* in the flat position which shows the hinges 60. FIG. 4*c* illustrates a perspective view of the floor in a slightly folded position. The holes for accommodating the floor pins are shown on the side of floor panel along which the panels are hinged. When the floor pins are removed, the floor can be folded such that the bottom sides of the floor panels are flush (not shown) to facilitate storage and transport of the floor. The floor is preferably comprised of frame weldments 50 having an aluminum treadplate 52 welded thereto. Bolts, nuts and washers are installed through holes 56 to facilitate lifting of the floor during assembly or disassembly.

Figure 5:
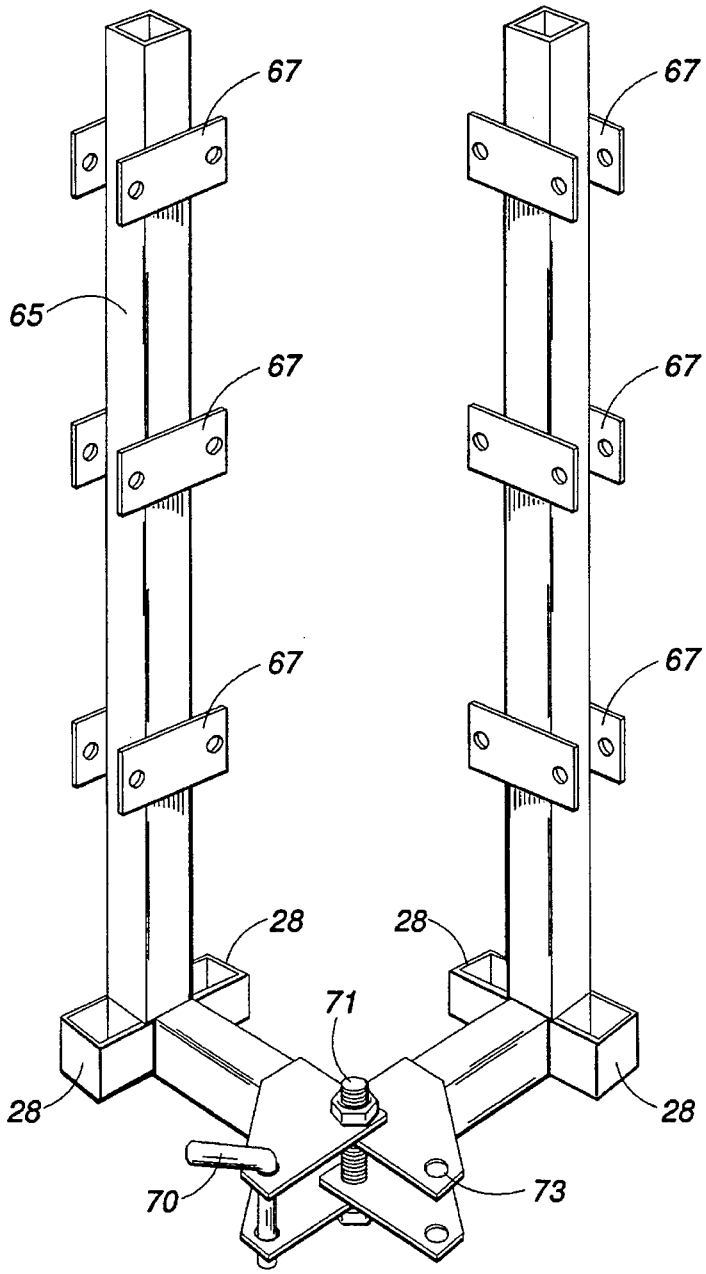
FIG. 5 illustrates a connecting frame which can be used with the suspended access platform of the present invention.

FIG. 5 illustrates a connecting frame 65 which can be used to extend the length of the suspended access platform shown in FIG. 1. Rather than using an end stirrup on both ends of the suspended access platform, one end of the platform is connected to the connecting frame 65 shown in FIG. 5. The connecting frame has the same type of hinging mechanism used for the end stirrup. The connecting frame also works essentially the same way as the end stirrup with the exception that the connecting frame does not have to have a suspension mechanism. The connecting frame simply allows a second set of side panels and side rails and another floor section to be extended in the lengthwise direction of the suspended access platform. A connecting frame or second end stirrup is then fastened to the free end of the succeeding set of side panels and side rails in the same manner as discussed above with respect to FIG. 1. The connecting frame incorporates locking-pin arrangements 67 which are the same as those of the end stirrups. The tethered lock pins (not shown) are also part of the connecting frame. The center locking-pin arrangements are double tabbed for accommodating two middle side rails. The reason for having the double tab is that it allows the top side rail to be disconnected from the uppermost locking-pin arrangement and reconnected at the double tabbed locking-pin arrangement. This is especially useful when the top side rail is restricting a worker's access to the object being worked on.

FIG. *6a* illustrates the end stirrup hinging mechanism which is also incorporated by the connecting frame of FIG. 5. The outer hinge weldment 77 is connected to the inner hinge weldment 75 by a lock pin 80 and a nut, bolt and washer (not shown). FIG. *6b* illustrates a top view of the hinging mechanism. Holes passing through outer hinge weldment 77 and inner hinge weldment 75 can be concentrically aligned. The bolt passes through hole 85 connecting the hinge weldments in a hinging configuration. The lock pin 80 is inserted through hole 83 in order to lock the end stirrup or connecting frame in the operative position. When the lock pin is removed, the half end stirrups are permitted to rotate with respect to each other.

Assembly of the suspended access platform can be accomplished by one person quickly and easily. Assembly of the platform may be accomplished as follows. One of the end stirrups (or connecting frames) is locked in the operative position as discussed above. The legs of the side panels are then inserted into the recesses on the end stirrup. The top ends of the side panels are then fastened to the end stirrup by lock-pin arrangements. Another end stirrup is then locked in its operative position and the free ends of the side panels are then removably connected to the end stirrup in the same manner that the side panels were attached to the first end stirrup. The suspension mechanisms are then fastened by lock pins to the end stirrups, as discussed above with respect to FIG. 2. The floor may then be installed between the side panels by placing the floor on the lips on the inside of the side panels which provide support for the floor. As can be seen best by FIG. 1, the outer side of first floor panel 49 is connected to the first side panel 5, and the outer side of second floor panel 51 is connected to the second side panel 7 by a plurality of pins, wherein each pin passes through holes 47 formed in the first side panel 5, through corresponding concentrically aligned holes in the floor panels 49, 51, and through holes in the second side panel 7. Each of these pins comprises locking means for preventing the pin from backing out when the pin is locked into position by the locking means. With the floor pins so inserted through the concentrically aligned holes in the side panels and the floor panels, and locked in place therein, the floor is maintained in a fixed position. The middle and top rails are then connected by lock-pin arrangements to the end stirrups.

In order to assemble a platform having more than one section, connecting frames such as the one shown in FIG. 5 are used. The connecting frame is first locked in its operative position by aligning the holes in the outer and inner hinge weldments and inserting the lock-pin through the holes. One end of each of the two side panels is removably connected to either side of the connecting frame by placing the legs of the ends of the side panels in the recesses on the connecting frame. The top ends of the side panels above the legs are then connected by lock-pins to the connecting frame. Another set of side panels is then removably connected to the opposite side of the connecting frame in the same manner. The connecting frames and side panels continue to be assembled in this manner until the desired platform length is attained. End stirrups are then fastened, as discussed above, to the free ends of the side panels. The floors are then installed between the side panels and locked into place with the floor pins as discussed above. The middle and top side rails are then connected by lock pins to the end stirrups or connecting frames. The suspension mechanisms are then connected to the end stirrups and the hoist mechanisms can be connected to the suspension mechanisms for suspending the platform. Preferably, the optional casters are removably connected to the end stirrups and connecting frames before the platform is assembled.

Preferably, the suspended access platform is disassembled in the reverse order in which it was assembled. Once the suspended access platform has been disassembled, the hinging mechanism of the end stirrups can be unlocked and the end stirrups can be folded. Similarly, once the floor has been disconnected from the side panels by removing the floor pins, the floor can be folded such that the bottom sides of the floor panels are flush. Once the suspended access platform has been completely disassembled, the components of the suspended access platform can easily be transported through small openings such as access openings to boiler vessels.

The method for assembling the suspended access platform of the present invention discussed above is merely a preferred or recommended method for assembling the platform. The order in which the platform is assembled and disassembled is generally not critical. The types of materials used to make the components of the suspended access platform are also not critical. Preferably, the components are comprised of aluminum or steel. This allows the suspended access platform to be lightweight in construction which further facilitates transport of the components of the platform. Also, it is not critical that locking pin arrangements are used to removeably fasten the components of the platform together. Other types of locking arrangements which allow the components to be easily connected and disconnected and which are equally as safe as the locking pin arrangements can also be used with the present invention. Moreover, the overall length/width dimensions of the platform components are not critical and the number of extensions that may be added to the platform is generally limited only insofar as safe working load is concerned.

Although the present invention has been described with respect to preferred embodiments, it will be apparent to those skilled in the art that modifications to the invention may be made which are within the spirit and scope of the present invention.

I claim:

1. A suspended access platform comprising:

a floor comprised of first and second floor panels, each of said floor panels having a first end and a second end, an inner side and an outer side, and a top and a bottom, the inner side of said first panel being rotatably connected to the inner side of said second panel by a hinging means which permits movement of said floor panels relative to each other when said platform is inoperative, and wherein said floor is locked in a flat position when said platform is operative;

first and second side panels each having a first end, a second end, an inner side, and an outer side, wherein the inner sides of said side panels comprise means for supporting said floor;

a front stirrup removably connected to the first ends of said side panels, said front stirrup comprised of a first front half stirrup and a second front half stirrup, said first and second front half stirrups being rotatably connected together by a hinging mechanism which can be locked in place to prevent movement of said front half stirrups and which can be unlocked to allow rotation of said front half stirrups with respect to each other; and a back stirrup removably connected to the second ends of said side panels, said back stirrup comprised of a first back half stirrup and a second back half stirrup, said first and second back half stirrups being rotatably connected together by a hinging mechanism which can be locked in place to prevent movement of said back half stirrups and which can be unlocked to allow rotation of said back half stirrups with respect to each other.

2. A suspended access platform according to claim 1, said platform further comprising a first side rail having first and second ends, the first end being removably connected to said first front half stirrup, the second end being removably connected to said first back half stirrup, a second side rail having first and second ends, the first end of said second side rail being removably connected to said second front half stirrup, the second end of said second rail being connected to said second back half stirrup, a third rail having first and second ends, the first end of said third rail being removably connected to said first front half stirrup, the second end of said third rail being removably connected to said first back half stirrup, and a fourth rail having first and second ends, the first end of said fourth rail being removably connected to said second front half stirrup, the second end of said fourth rail being removably connected to said second back half stirrup.

3. A suspended access platform according to claim 1 wherein the inner sides of said floor panels have flanges connected thereto, wherein the flanges on said first floor panel are alternatingly opposed to said flanges connected to said second floor panel such that, when said floor is in a flat position, said flanges connected to said first floor panel overlap said second floor panel and said flanges connected to said second floor panel overlap said first floor panel.

4. A suspended access platform according to claim 1 wherein said suspended access platform further comprises a plurality of pins for connecting said first side panel to the outer side of said first floor panel and said second side panel to the outer side of said second floor panel, wherein each pin passes through holes formed in said first side panel, said floor panels, and said second side panel, each of said pins comprising locking means for preventing the pin from backing out when the pin is locked into position by said locking means.

5. A suspended access platform according to claim 1 wherein the first and second ends of the side panels have legs thereon and wherein the first ends of said side panels are removably connected to said front stirrup by placing the legs on the first ends in recesses contained on said front stirrup and wherein the second ends of said side panels are removably connected to said back stirrup by placing the legs on said second ends in recesses contained on said back stirrup.

6. A suspended access platform according to claim 2 wherein the ends of said first, second, third and fourth rails are removably connected to said half stirrups or half connecting frames by lock-pin arrangements.

7. A suspended access platform according to claim 5 wherein the first and second ends of said side panels are also connected to said front and back stirrups, respectively, by lock-pin arrangements.

8. A suspended access platform according to claim 6 wherein each lock-pin arrangement comprises a locking pin which is permanently attached to said platform by a flexible attaching means.

9. A suspended access platform comprising:

a floor comprised of at least first and second floor sections, each floor section having at least a first end, a second end, a top and a bottom;

first, second, third and fourth side panels, each side panel having a first end, a second end, an inner side and an outer side, wherein the inner sides of said side panels comprise means for supporting said floor;

a front stirrup removably connected to the first ends of said first and second side panels, said front stirrup comprised of a first front half stirrup and a second front half stirrup, said first and second front half stirrups being rotatably connected together by a hinging mechanism which can be locked in place to prevent movement of said front half stirrups and which can be unlocked to allow rotation of said front half stirrups with respect to each other;

a connecting frame removably connected to the second ends of said first and second side panels and removably connected to the first ends of said third and fourth side panels, wherein said connecting frame is comprised of two half connecting frames which are rotatably connected together by a hinging mechanism wherein said hinging mechanism of said connecting frame can be locked in place to prevent movement of said half connecting frames and which can be unlocked to allow rotation of said half connecting frames with respect to each other;

a back stirrup removably connected to the second ends of said third and fourth side panels, said back stirrup comprised of a first back half stirrup and a second back half stirrup, said first and second back half stirrups being rotatably connected together by a hinging mechanism which can be locked in place to prevent movement of said back half stirrups and which can be unlocked to allow rotation of said back half stirrups with respect to each other.

10. A suspended access platform according to claim 9 wherein said first and second floor sections are each comprised of first and second floor panels, each of said floor panels having a first end and a second end, an inner side and an outer side, and a top and a bottom, the inner side of said first panel of said first floor section being rotabably connected to the inner side of said second panel of said first floor section by a first hinging means, the inner side of said first panel of said second floor section being rotatably connected to the inner side of said second panel of said second floor section by a second hinging means, wherein said first and second hinging means permit said first and second floor sections to be folded once said platform has been disassembled such that the bottoms of said floor panels of said first floor section are adjacent one another and the bottoms of said floor panels of said second floor section are adjacent one another.

11. A suspended access platform according to claim 10 wherein the inner sides of said floor panels have flanges connected thereto, wherein the flanges connected to said first floor panel of said first floor section are alternatingly opposed to said flanges connected to said second floor panel of said first floor section and wherein the flanges connected to said first floor panel of said second floor section are alternatingly opposed to said flanges connected to said second floor panel of said second floor section such that when said floor sections are in a flat position said flanges connected to said first floor panel of said first floor section overlap said second floor panel of said first floor section and said flanges connected to said second floor panel of said first floor section overlap said first floor panel of said first floor section and said flanges connected to said first floor panel of said second floor section overlap said second floor panel of said second floor section and said flanges connected to said second floor panel of said second floor section overlap said first floor panel of said second floor section.

12. A suspended access platform according to claim 9 wherein said platform further comprises a plurality of pins for connecting said first side panel to the outer side of said first floor panel of said first floor section and said second side panel to the outer side of said second floor panel of said first floor section and for connecting said third side panel to the outer side of said first floor panel of said second floor section and said fourth side panel to the outer side of said second floor panel of said second floor section, wherein each pin passes through holes formed in said side panels and in said floor panels, each of said pins comprising locking means for preventing the pins from backing out of the holes when the pin is locked into position by said locking means.

13. A suspended access platform according to claim 9 wherein the first and second ends of said side panels have legs thereon and wherein the first ends of said first and second side panels are removably connected to said front stirrup by placing the legs on the first ends in recesses contained on said front stirrup and wherein the second ends of said first and second side panels are removably connected to said connecting frame by placing the legs on said second ends of said first and second side panels in recesses contained on said connecting frame and wherein the first ends of said third and fourth side panels are removably connected to said connecting frame by placing the legs on said first ends of said third and fourth side panels in recesses contained on said connecting frame and wherein the second ends of said third and fourth side panels are removably connected to said back stirrup by placing the legs on said second ends of said third and fourth side panels in recesses contained on said back stirrup.

14. A suspended access platform according to claim 13 wherein said first ends of said first and second side panels are also connected to said front stirrup by lock-pin arrangements and wherein the second ends of said first and second side panels are also connected to said connecting frame by lock-pin arrangements and wherein the first ends of said third and fourth side panels are also connected to said connecting frame by lock-pin arrangements and wherein the second ends of said third and fourth side panels are also connected to said back stirrup by lock-pin arrangements.

15. A suspended access platform according to claim 9, said platform further comprising a first side rail having first and second ends, the first end being removably connected to said first front half stirrup, the second end being removably connected to a first side of said connecting frame, a second side rail having first and second ends, the first end of said second side rail being removably connected to said second front half stirrup, the second end of said second side rail being connected to a second side of said connecting frame, a third side rail having first and second ends, the first end of said third side rail being removably connected to the first side of said connecting frame, the second end of said third rail being removably connected to said first back half stirrup, and a fourth side rail having first and second ends, the first end of said fourth side rail being removably connected to the second side of said connecting frame, the second end of said fourth side rail being removably connected to said second back half stirrup.

* * * * *